US012022882B2

(12) United States Patent
Lin et al.

(10) Patent No.: US 12,022,882 B2
(45) Date of Patent: Jul. 2, 2024

(54) ELECTRONIC CIGARETTE WITH AUTOMATIC PREHEATING IN ANTICIPATION OF SMOKING ACTION AND CONTROL METHOD THEREOF

(71) Applicant: SHENZHEN HAPPY VAPING TECHNOLOGY LIMITED, Guangdong (CN)

(72) Inventors: Guangrong Lin, Guangdong (CN); Xianbin Zheng, Guangdong (CN); Xiyong Zhang, Guangdong (CN)

(73) Assignee: SHENZHEN HAPPY VAPING TECHNOLOGY LIMITED, Shenzhen (CN)

( * ) Notice: Subject to any disclaimer, the term of this patent is extended or adjusted under 35 U.S.C. 154(b) by 375 days.

(21) Appl. No.: 17/640,875

(22) PCT Filed: Aug. 12, 2020

(86) PCT No.: PCT/CN2020/108592
§ 371 (c)(1),
(2) Date: Mar. 7, 2022

(87) PCT Pub. No.: WO2021/073227
PCT Pub. Date: Apr. 22, 2021

(65) Prior Publication Data

US 2022/0322748 A1 Oct. 13, 2022

(30) Foreign Application Priority Data

Oct. 18, 2019 (CN) ..... 201910996082.2

(51) Int. Cl.
*A24F 40/53* (2020.01)
*A24F 40/10* (2020.01)
(Continued)

(52) U.S. Cl.
CPC ..... *A24F 40/53* (2020.01); *A24F 40/10* (2020.01); *A24F 40/51* (2020.01); *A24F 40/57* (2020.01); *A24F 40/60* (2020.01)

(58) Field of Classification Search
CPC ..... A24F 40/10; A24F 40/50; A24F 40/57; A24F 1/14
See application file for complete search history.

(56) References Cited

U.S. PATENT DOCUMENTS 10,334,887 B1 * 7/2019 Qiu ..... A24F 40/49
2016/0157524 A1 * 6/2016 Bowen ..... A61M 15/06
(Continued)

FOREIGN PATENT DOCUMENTS

CN 103230100 A 8/2013
CN 108371352 A 8/2018
(Continued)

OTHER PUBLICATIONS

International Search Report of PCT Patent Application No. PCT/CN2020/108592 issued on Dec. 3, 2020.

*Primary Examiner* — Truc T Nguyen

(57) ABSTRACT

Disclosed is an electronic cigarette with automatic preheating in anticipation of a smoking action and a control method thereof, where the electronic cigarette includes a liquid storage chamber, a battery, a vaporizing device, a control circuit, and a preheating element, the control circuit is provided with electronic components including a gravity sensor, a temperature detection unit, and a microcontroller, and is configured as: when the gravity sensor senses a certain range of a movement change of the electronic cigarette, the microcontroller predetermines that the movement change indicates a smoking action, the microcontroller determines whether to preheat according to a real-time temperature value detected by the temperature detection unit, if the smoking action is indicated and preheating is required, the
(Continued)

preheating element is controlled to heat for a preset heating period or until a preset target temperature value is reached, the electronic cigarette enters a standby smoking state.

13 Claims, 4 Drawing Sheets

(51) Int. Cl.

| | |
|---|---|
| ***A24F 40/51*** | (2020.01) |
| ***A24F 40/57*** | (2020.01) |
| ***A24F 40/60*** | (2020.01) |

(56) References Cited

U.S. PATENT DOCUMENTS

| | | | | |
|---|---|---|---|---|
| 2017/0064997 | A1* | 3/2017 | Murison | A24F 40/53 |
| 2017/0099878 | A1* | 4/2017 | Murison | A24F 15/015 |
| 2018/0360119 | A1* | 12/2018 | Kuwa | A24F 40/60 |
| 2019/0350256 | A1* | 11/2019 | Hejazi | A24F 40/46 |
| 2019/0387793 | A1* | 12/2019 | Angelico | A61M 15/06 |
| 2020/0037663 | A1* | 2/2020 | Chau | H05B 1/0227 |

FOREIGN PATENT DOCUMENTS

| | | | |
|---|---|---|---|
| CN | 109717518 | A | 5/2019 |
| CN | 110200327 | A | 9/2019 |
| CN | 110200328 | A | 9/2019 |
| CN | 110200329 | A | 9/2019 |
| CN | 110200330 | A | 9/2019 |
| CN | 110301681 | A | 10/2019 |
| IN | 107156915 | A | 9/2017 |

* cited by examiner

ELECTRONIC CIGARETTE WITH AUTOMATIC PREHEATING IN ANTICIPATION OF SMOKING ACTION AND CONTROL METHOD THEREOF

TECHNICAL FIELD

The present disclosure relates to a field of electronic cigarette preheating technology, and more particularly, the present disclosure relates to an electronic cigarette with automatic preheating in anticipation of a smoking action and a control method thereof.

BACKGROUND

An electronic cigarette usually heats and vaporizes a liquid substance or a paste substance such as a drug and an electronic cigarette liquid to generate aerosols or vapor for a smoker. Different from tobacco cigarettes which may be directly combusted to generate smoke, the electronic cigarette generates vapor without cigarette tar and many harmful particles, so the application of electronic cigarettes is popularized.

Existing electronic cigarettes usually include an electronic cigarette liquid and a heating coil for vaporizing the electronic cigarette liquid. The electronic cigarette liquid is usually stored in a liquid storage chamber. During vaporization, the electronic cigarette liquid in the liquid storage chamber penetrates or is transmitted to the heating coil. When the electronic cigarette is turned on and used, there is usually no preheating control method or program to preheat the electronic cigarette. Especially when the electronic cigarette is used in a cold winter or in a cold area of high altitude or high latitude, the electronic cigarette liquid or tobacco tar, and a liquid substance containing a drug may have higher viscosity and lower fluidity under low temperature conditions, so that the electronic cigarette liquid or the drug is not easy to penetrate or flow to a heater for vaporization, which makes it difficult for a user to effectively smoke when the electronic cigarette is just activated. Therefore, to this end, it is desired to provide an electronic cigarette which utilizes a method having preheating control when the electronic cigarette starts to be used, to preheat the electronic cigarette liquid or the liquid substance containing the drug by a heater so as to facilitate smoking.

SUMMARY

An object of the present disclosure is to provide an electronic cigarette with automatic preheating in anticipation of a smoking action and a control method thereof in order to overcome the deficiencies of the above-mentioned technology.

The technical solution of the present disclosure is achieved as follows. An electronic cigarette with automatic preheating in anticipation of a smoking action includes a liquid storage chamber, a battery, a vaporizing device, a control circuit, and a preheating element, wherein the liquid storage chamber is configured to store an electronic cigarette liquid, the battery powers the control circuit, the vaporizing device, and the preheating element, the vaporizing device is used for transmitting, heating, and vaporizing the electronic cigarette liquid, and the control circuit is provided with several electronic components electrically connected to each other, the electronic components include a gravity sensor, a temperature detection unit, and a microcontroller with a preset parameter unit, the preset parameter unit is configured to store and preset related preset parameters, the preset parameters include a preset minimum temperature value, a preset heating period, or a preset target temperature value, the gravity sensor is configured to sense a movement change of the electronic cigarette, and the temperature detection unit is configured to detect a real-time temperature of the electronic cigarette liquid in the liquid storage chamber or an environment, the preheating element is configured to heat the electronic cigarette liquid in the liquid storage chamber, wherein the control circuit is configured in such a manner that, when the gravity sensor senses a certain range of the movement change of the electronic cigarette, the microcontroller predetermines that the movement change indicates a smoking action and meanwhile determines whether it is necessary to preheat the electronic cigarette liquid in the liquid storage chamber according to a comparison between the real-time temperature value detected by the temperature detection unit and the preset minimum temperature value, if the smoking action is indicated but preheating is not required, the microcontroller controls the electronic cigarette to enter a standby smoking state directly, if the smoking action is indicated and the preheating is required, the microcontroller controls the preheating element to heat for the preset heating period or until the preset target temperature value is reached, and then controls the electronic cigarette to enter the standby smoking state.

Preferably, the preset parameters may further include a preset movement range parameter that simulates a user's gesture of picking up the electronic cigarette by hand when preparing to smoke. The microcontroller may be configured to predetermine that the movement change indicates the smoking action when the gravity sensor senses that the electronic cigarette has the certain range of the movement change which matches the preset movement range parameter.

Preferably, the electronic components may further include a pressure sensor, the pressure sensor is configured to indirectly sense a change of an altitude by detecting a change of external air pressure. The microcontroller may be configured to predetermine that the movement change indicates the smoking action when the gravity sensor senses the certain range of the movement change of the electronic cigarette and meanwhile the pressure sensor also senses that the movement change has a certain change of an altitude difference from low to high.

Preferably, the electronic components may further include a microphone, an airflow sensor, or an air pressure sensor, and the microphone, the airflow sensor, or the air pressure sensor is configured to detect a change of an air flow or air pressure during smoking, to allow the microcontroller to determine whether the user is smoking.

Preferably, the preset parameters may further include a preset standby time. The microcontroller may be configured to control the electronic cigarette to automatically enter a sleep state if the microphone, the airflow sensor, or the air pressure sensor detects that the user has not smoked within the preset standby time after the electronic cigarette enters the standby smoking state.

Preferably, the preheating element may be an electric heater arranged in the liquid storage chamber or out of the liquid storage chamber, the electric heater is configured to heat the electronic cigarette liquid in the liquid storage chamber when being energized; or, the preheating element may be a heating element disposed in the vaporizing device for vaporizing electronic cigarette liquid, the heating element is configured to conduct heat to the electronic cigarette liquid in the liquid storage chamber when being energized.

Preferably, the control circuit may further include a preheating prompting unit, the preheating prompting unit may include an LED indicator, and a vibrator or a buzzer, the microcontroller may be configured to control the LED indicator to emit light for warning when the microcontroller determines that preheating is required, and control the vibrator or the buzzer to provide vibration or sound for warning when the preheating is completed.

Preferably, the preset heating period may be set as a fixed value, or may be set as a variable value having a linear inverse proportional function relation with the real-time temperature value, that is, the lower the real-time temperature value, the longer the preset heating period.

Preferably, the preset parameters may further include a preset preheating power, and the preset preheating power may be set as a fixed value, or may be set to have a linear inverse proportional function relation with the real-time temperature value, that is, the lower the real-time temperature value, the greater the preset preheating power.

Preferably, the temperature detection unit may include an independent temperature sensor; or, a heating coil for vaporizing the electronic cigarette liquid is used as a temperature sensor, and the heating coil has a characteristic of a thermosensitive resistor.

Another technical solution of the present disclosure is achieved as follows: a control method of an electronic cigarette with automatic preheating in anticipation of a smoking action, including following steps:

(1) presetting related preset parameters through a microcontroller;
(2) sensing a movement change of the electronic cigarette by means of a gravity sensor, and meanwhile detecting a real-time temperature of an electronic cigarette liquid in a liquid storage chamber or an environment by means of a temperature detection unit;
(3) predetermining whether the movement change indicates a smoking action by means of the microcontroller, if yes, go to next step, if no, return to previous step;
(4) by means of the microcontroller, comparing a real-time temperature value with a preset minimum temperature value, and determining whether preheating is required for the electronic cigarette, if yes, go to next step, if no, go to step (6);
(5) controlling a preheating element to be energized for preheating by means of the microcontroller;
(6) controlling the electronic cigarette to enter a standby smoking state by means of the microcontroller.

Another technical solution of the present disclosure is achieved as follows: a control method of an electronic cigarette with automatic preheating in anticipation of a smoking action, including following steps:

(1) presetting related preset parameters through a microcontroller;
(2) sensing a movement change of the electronic cigarette by means of a gravity sensor and meanwhile sensing a change of an altitude difference by means of a pressure sensor, and detecting a real-time temperature of an electronic cigarette liquid in a liquid storage chamber or an environment by means of a temperature detection unit;
(3) by means of the microcontroller, predetermining whether the movement change and the change of the altitude difference indicate the smoking action, if yes, go to next step, if no, return to previous step;
(4) by means of the microcontroller, comparing a real-time temperature value with a preset minimum temperature value, and determining whether preheating is required for the electronic cigarette, if yes, go to next step, if no, go to step (6);
(5) controlling a preheating element to be energized for preheating by means of the microcontroller;
(6) controlling the electronic cigarette to enter a standby smoking state by means of the microcontroller.

Another technical solution of the present disclosure is achieved as follows: a control method of an electronic cigarette with automatic preheating in anticipation of a smoking action, including following steps:

(1) presetting related preset parameters through a microcontroller;
(2) sensing a movement change of the electronic cigarette by means of a gravity sensor, and meanwhile detecting a real-time temperature of an electronic cigarette liquid in a liquid storage chamber or an environment by means of a temperature detection unit;
(3) by means of the microcontroller, predetermining whether the movement change indicates the smoking action, if yes, go to next step, if no, return to previous step;
(4) by means of the microcontroller, comparing a real-time temperature value with a preset minimum temperature value, and determining whether preheating is required for the electronic cigarette, if yes, go to next step, if no, go to step (6);
(5) controlling a preheating element to be energized for preheating by means of the microcontroller;
(6) controlling the electronic cigarette to enter a standby smoking state by means of the microcontroller;
(7) detecting an air flow of smoking by means of a microphone;
(8) by means of the microcontroller, determining whether a user takes a puff within a preset standby time, if yes, go back to step (6), if no, go to next step;
(9) controlling the electronic cigarette to enter a sleep state by means of the microcontroller.

The beneficial effects of the present disclosure are as follows. The present disclosure discloses an electronic cigarette with automatic preheating in anticipation of a smoking action, which senses a movement of the electronic cigarette by means of a gravity sensor, and predetermines whether it indicates a smoking action, and meanwhile detect a real-time temperature of an electronic cigarette liquid or an environment by means of the temperature detection unit, and then automatically compare them to determine whether preheating is required. When the smoking action is indicated and preheating is required, a microcontroller controls a preheating element to heat for a preset heating period or until a preset target temperature value is reached, and then the electronic cigarette enters a standby smoking state. In this way, even if the electronic cigarette is used in a cold winter or in a cold area of high altitude or high latitude, a user does not need to perform manual operation, and the electronic cigarette can automatically recognize the smoking action. When the user smokes, the electronic cigarette can automatically preheat the electronic cigarette liquid to enable it to easily penetrate or flow to a vaporizing device of the electronic cigarette for vaporization, so that the electronic cigarette can be used to smoke easily even at low temperature.

DETAILED DESCRIPTION

In order to make the objects, technical solutions, and advantages of the present disclosure clearer, the present disclosure will be further described in detail below with reference to the accompanying drawings and embodiments. It should be understood that the specific embodiments described herein are merely used for explaining the present disclosure, and are not intended to limit the present disclosure.

First of all, it should be noted that the electronic cigarette liquid in the liquid storage chamber disclosed in the present disclosure not only refers to a flowable electronic cigarette liquid, but also includes poor fluidity or waxy cigarette tar, solidification of the electronic cigarette liquid, a liquid substance containing a drug, or solidification of waxy liquid medicine, etc.

The present disclosure discloses an electronic cigarette that preheats an electronic cigarette liquid with poor fluidity before smoking. In particular, it is not necessary to manually press a preheating switch to start preheating. Instead, it uses a sensing function of a gravity sensor, simulating a common action track of a user's gesture of picking up the electronic cigarette by hand when preparing to smoke, establishing modulus, and presetting a relevant movement range parameter. When the gravity sensor senses that the electronic cigarette has a certain range of a movement change and meets a preset movement range parameter, a microcontroller predetermines it as a smoking action, and then automatically perform preheating according to a detected temperature.

Example

Figure 1:
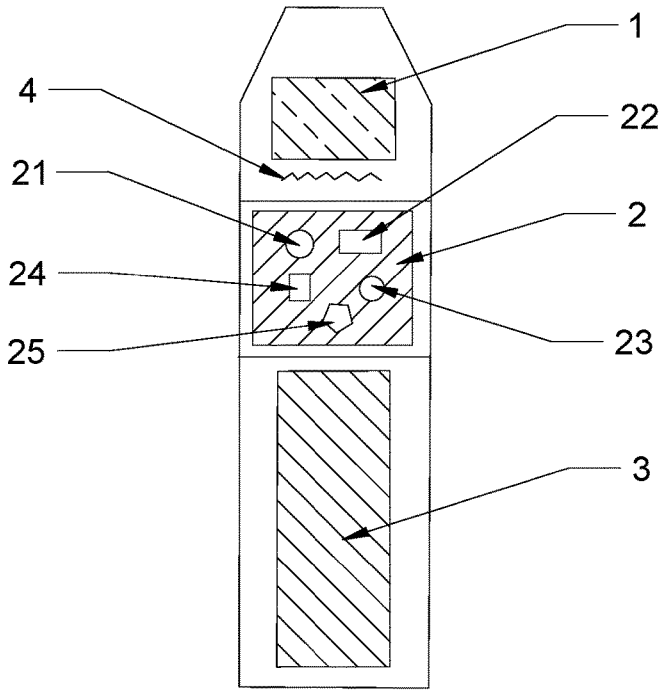
FIG. 1 is a schematic structural diagram of an electronic cigarette with automatic preheating in anticipation of a smoking action according to the present disclosure.

As shown in FIG. 1, an electronic cigarette with automatic preheating in anticipation of a smoking action, including a liquid storage chamber 1, a battery 3, a vaporizing device, a control circuit 2, and a preheating element 4, wherein the liquid storage chamber 1 is configured to store an electronic cigarette liquid, the battery 3 supplies power to the control circuit 2, the vaporizing device, and the preheating element 4. The vaporizing device is configured to transmit, heat, and vaporize the electronic cigarette liquid. The vaporizing device includes a heating element (not shown in the figures), and the heating element is configured to heat the electronic cigarette liquid and vaporize the electronic cigarette liquid into vapor-like smoke. In order to supply power to the heating element, the control circuit 2 is provided with a power output unit. The battery 3 supplies power to the control circuit 2 and the preheating element 4. The control circuit 2 is provided with several electronic components that are electrically connected to each other. The electronic components include a gravity sensor 21, a temperature detection unit 23, and a microcontroller 22 provided with a preset parameter unit. The preset parameter unit is configured to store and preset related preset parameters, and the preset parameters include a preset minimum temperature value, a preset heating period, or a preset target temperature value. The gravity sensor 21 is a sensor that converts a movement or gravity of the electronic cigarette into an electrical signal, and is mainly used for detecting parameters such as a tilt angle, inertial force, and three-dimensional coordinates to sense a movement change of the electronic cigarette. The temperature detection unit 23 is configured to detect a real-time temperature of the electronic cigarette liquid in the liquid storage chamber or an environment, and the preheating element 4 is configured to heat the electronic cigarette liquid in the liquid storage chamber 1.

The control circuit 2 is configured to has a functional structure as follows. In a sleep state of the electronic cigarette, the gravity sensor 21, the temperature detection unit 23, and the microcontroller 22 are still in a low power detection state. When the gravity sensor 21 senses a certain range of the movement change of the electronic cigarette, the microcontroller 22 predetermines that the movement change indicates a smoking action, and at the same time, the microcontroller 22 determines whether it is necessary to preheat the electronic cigarette liquid in the liquid storage chamber 1 according to a comparison between a real-time temperature value detected by the temperature detection unit 23 and the preset minimum temperature value. If the microcontroller 22 determines that the smoking action is detected and preheating is not required at the same time, the microcontroller 22 controls the electronic cigarette to enter a standby smoking state directly. If the microcontroller 22 determines that the smoking action is detected and preheating is required at the same time, then the microcontroller 22 controls the preheating element 4 to perform heating for the preset heating period or until the preset target temperature value is reached. In such a case, the preheating is completed, and the microcontroller 22 controls the electronic cigarette to enter the standby smoking state. The standby smoking state means that the power output unit has started to work and is in a standby state, and the power can be output to the vaporizing device to generate vapor when a user smokes.

As shown in FIG. 1, in order to avoid a mis-determination of the smoking action caused by a movement of the electronic cigarette in a pocket or a bag as a human body moves, the electronic cigarette of the present disclosure is further provided with a pressure sensor 24. The pressure sensor, which is highly sensitive, detects a change of external air pressure, and the external air pressure has a certain proportional relation with an altitude of a geographical location. Therefore, when the external air pressure is detected, the altitude can be indirectly detected. Thus, the present disclosure utilizes the highly sensitive pressure sensor 24 for indirectly sensing a change of the altitude. Usually, the movement of electronic cigarette in the pocket or the bag as the human body moves is a random shaking. On the contrary, during normal smoking, a movement of the electronic cigarette hold in one hand generally moves from low to high. Thus, the gravity sensor 21 senses the certain range of the movement change of electronic cigarette, and the pressure sensor 24 also senses that the movement change has a certain change of an altitude difference from low to high. Thus, the microcontroller 22 is configured to determine a movement change as the smoking action only when the above two movement modes are detected at the same time.

As shown in FIG. 1, the electronic components also include a microphone 25. The microphone 25 is configured to detect a change of an air flow during smoking, so that the microcontroller can determine whether the user smokes or not. Herein, the microphone 25 can be replaced by an airflow sensor or an air pressure sensor. The airflow sensor can also detect the change of the air flow. The air pressure sensor is configured to detect a change of air pressure. The internal air pressure of the electronic cigarette will also change when inhaling.

As shown in FIG. 1, the preheating element 4 is an electric heater arranged in or out of the liquid storage chamber 1. When the electric heater is energized, it can be dedicated to heating the electronic cigarette liquid in the liquid storage chamber. Alternatively, the preheating element is a heating element arranged in the vaporizing device for vaporizing the electronic cigarette liquid, and the heating element can conduct heat to the electronic cigarette liquid in the liquid storage chamber when it is energized.

Figure 2:
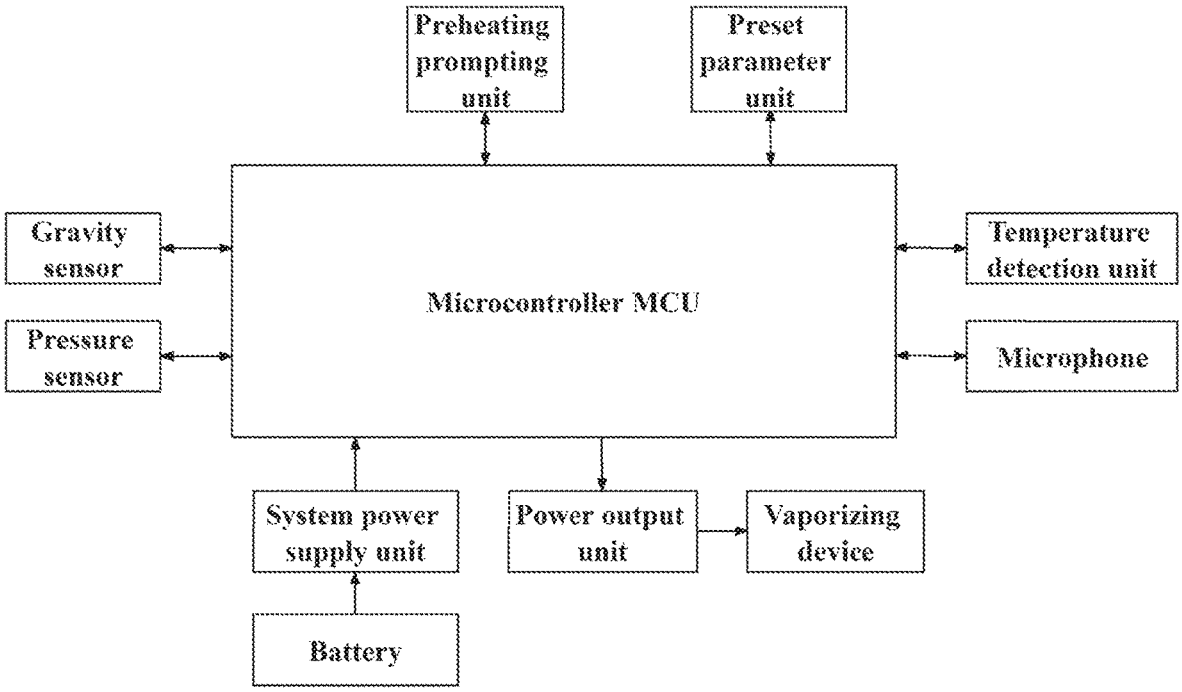
FIG. 2 is a functional structure diagram of an electronic cigarette with automatic preheating in anticipation of a smoking action according to the present disclosure.

As shown in FIG. 2, the electronic components include a gravity sensor, a temperature detection unit, a pressure sensor, a microphone (or an airflow sensor or an air pressure sensor), and a microcontroller MCU provided with a preset parameter unit. The microcontroller MCU, which is a command center of a control circuit, is electrically connected to the gravity sensor, the temperature detection unit, the pressure sensor, the microphone (or the airflow sensor or the air pressure sensor), a preheating prompting unit, the preset parameter unit, a power output unit, etc. at the same time. The preset parameter unit is configured to store and preset related preset parameters, including a preset minimum temperature value, a preset heating period, or a preset target temperature value, and the like. The power output unit is configured to output power to a vaporizing device, so as to heat and vaporize an electronic cigarette liquid. The microcontroller needs a power supply to work. Usually, the battery is not directly used as the power supply, and it is necessary to convert a battery voltage into a power supply that the microcontroller can use, through a system power supply unit.

The preset parameters also include a preset movement range parameter for simulating a user's gesture of picking up the electronic cigarette by hand when preparing to smoke. Only when the gravity sensor senses a certain range of a movement change of the electronic cigarette which matches the preset movement range parameter, the microcontroller can determine that the movement change is a smoking action.

The preset parameters also include a preset standby time. After the electronic cigarette enters a standby smoking state, the microcontroller controls the electronic cigarette to automatically enter a sleep state if the microphone, the airflow sensor, or the air pressure sensor detects that the user has not taken even a puff within the preset standby time.

As shown in FIG. 2, the control circuit also includes the preheating prompting unit, which includes an LED indicator, and a vibrator or a buzzer (not shown in the figures). When the microcontroller determines that preheating is required, the microcontroller controls the LED indicator to emit light for warning. When the preheating is completed, the microcontroller controls the vibrator or the buzzer to provide vibration or sound for warning. When the above-mentioned preheating is required or the above-mentioned preheating is completed, the preheating prompting unit, including the LED indicator, the vibrator, or the buzzer, may be configured with any one indication mode or in any combination.

The above-mentioned preset heating period may be set as a fixed value. Alternatively, it may be set as a variable value having a linear inverse proportional function relation with a real-time temperature value, that is, the lower the real-time temperature value, the longer the preset heating period. In this case, preheating may be fully achieved.

The preset parameters may also include a preset preheating power, and the preset preheating power may be set as a fixed value. Alternatively, it may be set to have a linear inverse proportional function relation with the real-time temperature value, that is, the lower the real-time temperature value, the greater the preset preheating power. In this case, preheating time may be reduced.

The temperature detection unit includes a temperature sensor (not shown in the figures), and the temperature sensor is an independent temperature sensor. Alternatively, a heating coil for vaporizing the electronic cigarette liquid is also used as the temperature sensor, and the heating coil has a characteristic of a thermosensitive resistor.

Embodiment 1 of another technical solution of the present disclosure.

Figure 3:
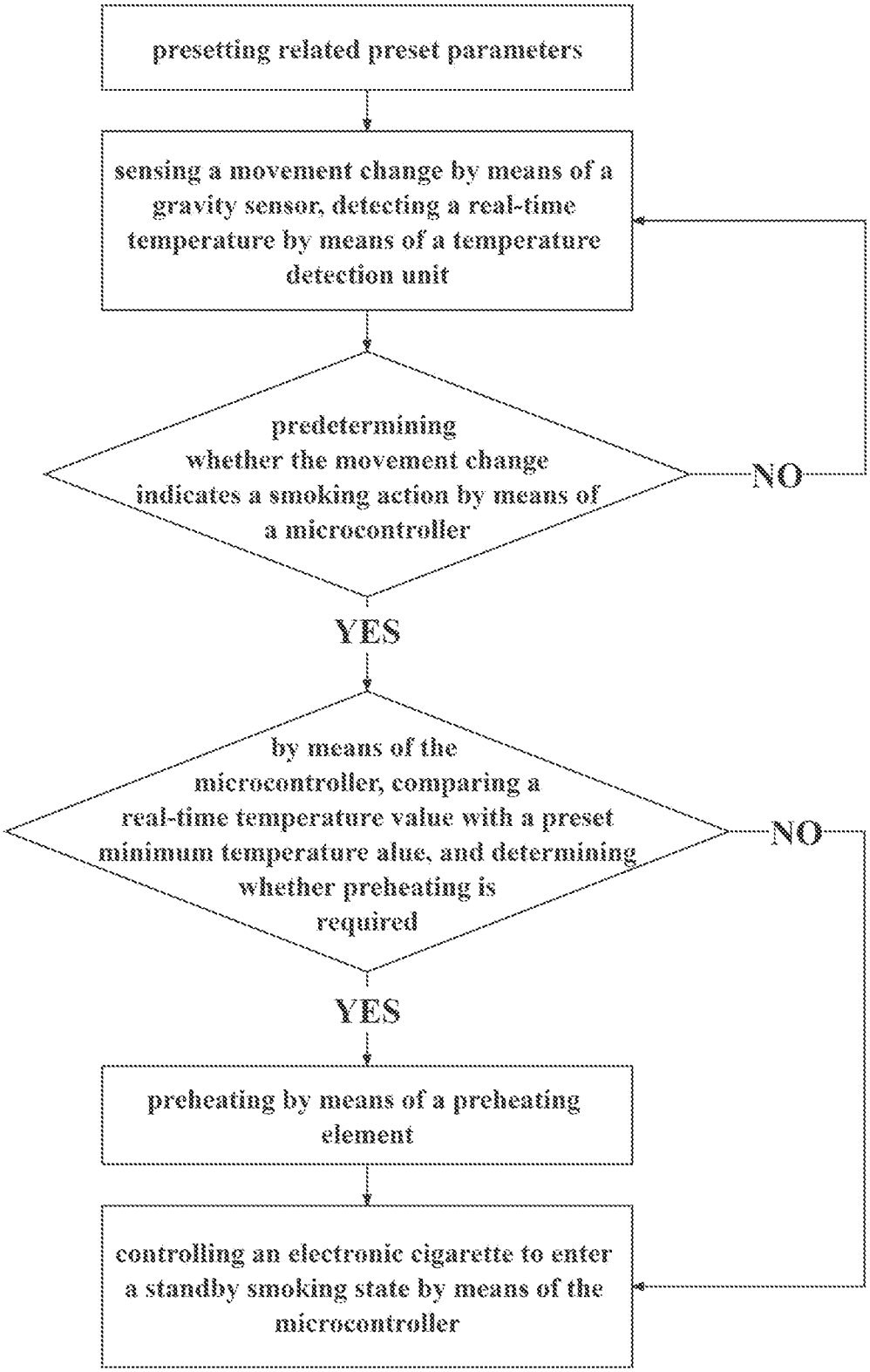
FIG. 3 is a first flow chart of a control method of an electronic cigarette with automatic preheating in anticipation of a smoking action according to the present disclosure.

As shown in FIG. 3, the control method of an electronic cigarette with automatic preheating in anticipation of a smoking action includes following steps:

(1) presetting related preset parameters by a microcontroller;

(2) sensing a movement change of the electronic cigarette by means of a gravity sensor, and detecting a real-time temperature of an electronic cigarette liquid in a liquid storage chamber or an environment by means of a temperature detection unit;

(3) predetermining whether the movement change indicates a smoking action by means of the microcontroller, if yes, go to next step, if no, return to previous step;

(4) comparing a real-time temperature value with a preset minimum temperature value by means of the microcontroller, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller.

Embodiment 2 of another technical solution of the present disclosure.

Figure 4:
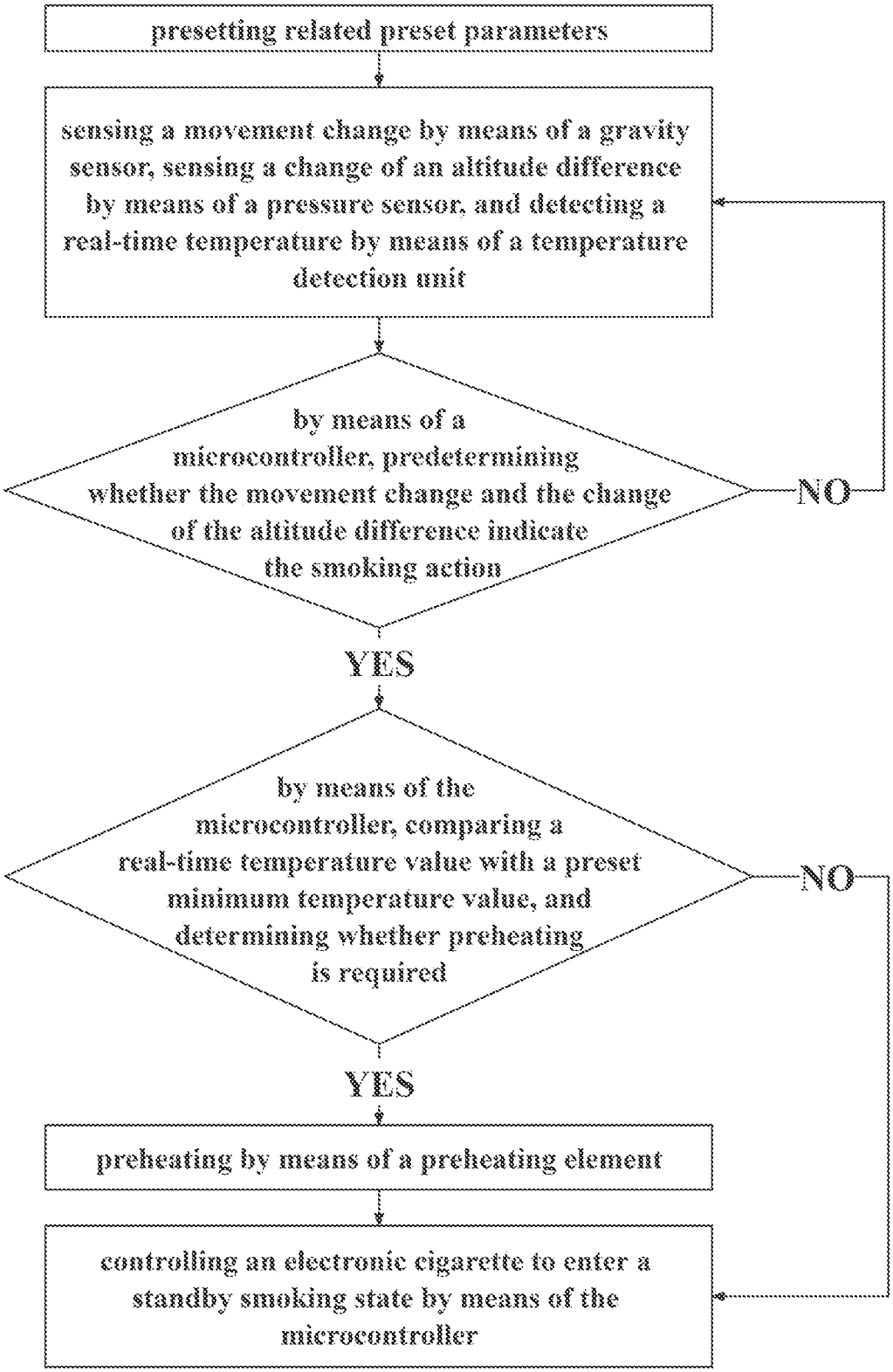
FIG. 4 is a second flow chart of a control method of an electronic cigarette with automatic preheating in anticipation of a smoking action according to the present disclosure.

As shown in FIG. 4, the control method of an electronic cigarette with automatic preheating in anticipation of a smoking action includes following steps:

(1) presetting related preset parameters through a microcontroller;

(2) sensing a movement change of the electronic cigarette by means of a gravity sensor and meanwhile sensing a change of an altitude difference by means of a pressure sensor, and detecting a real-time temperature of an electronic cigarette liquid in a liquid storage chamber or an environment by means of a temperature detection unit;

(3) by means of the microcontroller, predetermining whether the movement change and the change of the altitude difference indicates a smoking action, if yes, go to next step, if no, return to previous step;

(4) by means of the microcontroller, comparing a real-time temperature value with a preset minimum temperature value, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller.

Embodiment 3 of another technical solution of the present disclosure.

Figure 5:
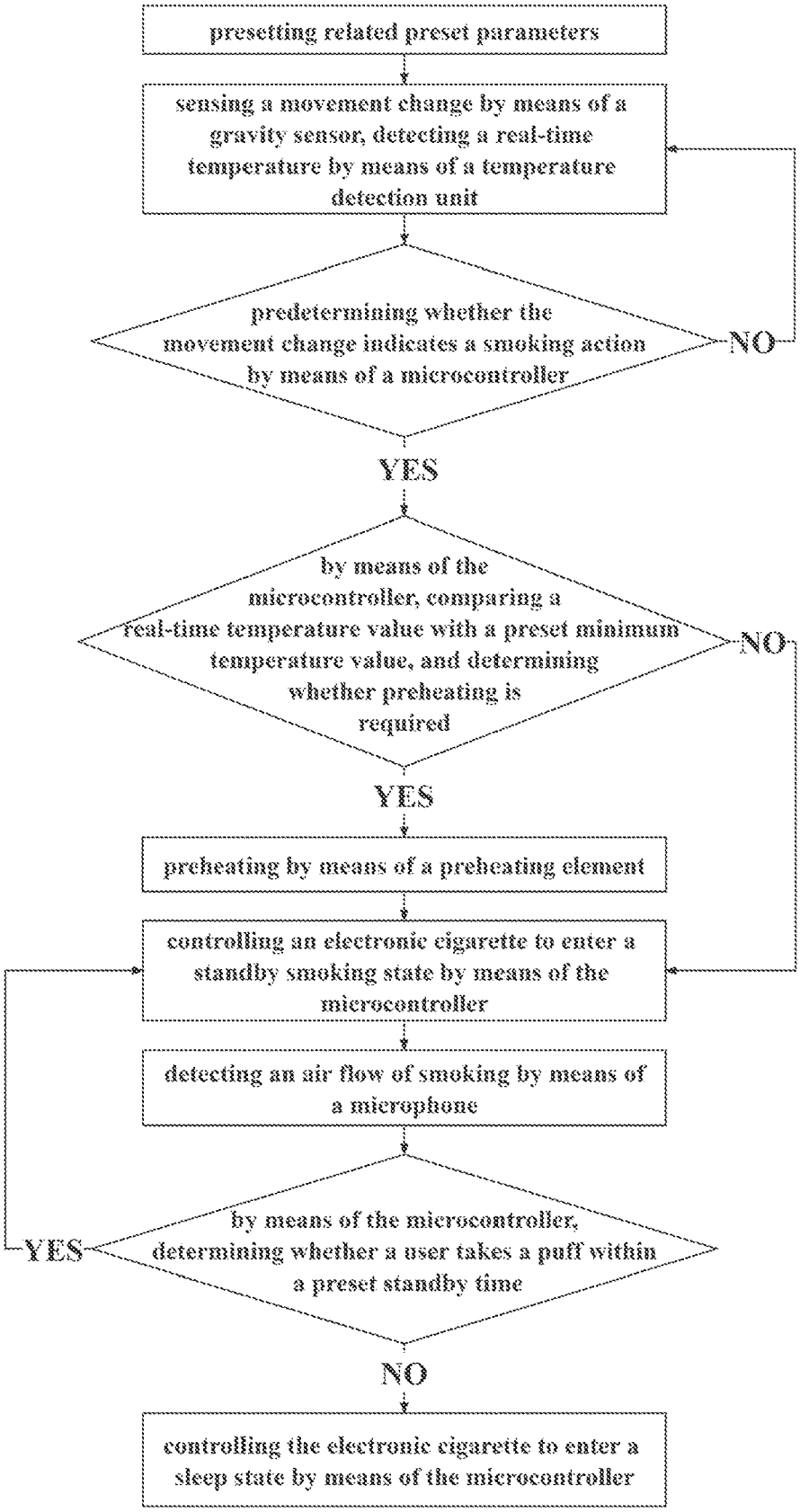
FIG. 5 a third flow chart of a control method of an electronic cigarette with automatic preheating in anticipation of a smoking action according to the present disclosure.

As shown in FIG. 5, the control method of an electronic cigarette with automatic preheating in anticipation of a smoking action includes following steps:

(1) presetting related preset parameters through a microcontroller;

(2) sensing a movement change of the electronic cigarette by means of a gravity sensor and meanwhile detecting a real-time temperature of an electronic cigarette liquid in a liquid storage chamber or an environment by means of a temperature detection unit;

(3) by means of the microcontroller, predetermining whether the movement change indicates a smoking action, if yes, go to next step, if no, return to previous step;

(4) by means of the microcontroller, comparing a real-time temperature value with a preset minimum temperature value, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller;

(7) detecting an air flow of smoking by means of a microphone;

(8) by means of the microcontroller, determining whether a user takes a puff within a preset standby time if yes, go back to step (6), if no, go to next step;

(9) controlling the electronic cigarette to enter a sleep state by means of the microcontroller.

The above descriptions are only preferred embodiments of the present disclosure, and the above specific embodiments do not limit the present disclosure. Within the scope of the technical idea of the present disclosure, various deformations and modifications may occur, and all modifications or equivalent replacements made by a person of ordinary skill in the art according to the above descriptions belong to the scope of protection of the present disclosure.

The invention claimed is:

1. An electronic cigarette with automatic preheating in anticipation of a smoking action, comprising a liquid storage chamber, a battery, a vaporizing device, a control circuit, and a preheating element, wherein the liquid storage chamber serves to store an electronic cigarette liquid, the battery powers the control circuit, the vaporizing device, and the preheating element, the vaporizing device is configured to transmit, heat, and vaporize the electronic cigarette liquid, the control circuit is provided with a plurality of electronic components electrically connected to each other, the electronic components comprise a gravity sensor, a temperature detection unit, and a microcontroller arranged with a preset parameter unit, the preset parameter unit is configured to store and preset related preset parameters, the preset parameters comprise a preset minimum temperature value, a preset heating period, or a preset target temperature value, the gravity sensor is configured to sense a movement change of the electronic cigarette, the temperature detection unit is configured to detect a real-time temperature of the electronic cigarette liquid in the liquid storage chamber or an environment, the preheating element is configured to heat the electronic cigarette liquid in the liquid storage chamber, wherein the control circuit is configured in such a manner that, when the gravity sensor senses a certain range of the movement change of the electronic cigarette, the microcontroller predetermines that the movement change indicates a smoking action, and meanwhile determines whether it is necessary to preheat the electronic cigarette liquid in the liquid storage chamber according to a comparison between a real-time temperature value detected by the temperature detection unit and the preset minimum temperature value, if the smoking action is indicated but preheating is not required the microcontroller controls the electronic cigarette to enter a standby smoking state directly, if the smoking action is indicated and the preheating is required, the microcontroller controls the preheating element to heat the electronic cigarette liquid for the preset heating period or until the preset target temperature value is reached, and then controls the electronic cigarette to enter the standby smoking state.

2. The electronic cigarette with automatic preheating in anticipation of a smoking action according to claim 1, wherein the preset parameters further comprise a preset movement range parameter that simulates a user's gesture of picking up the electronic cigarette by hand when preparing to smoke, and the microcontroller is configured to predetermine that the movement change indicates the smoking action when the gravity sensor senses that the electronic cigarette has the certain range of the movement change which matches the preset movement range parameter.

3. The electronic cigarette with automatic preheating in anticipation of a smoking action according to claim 1, wherein the electronic components further comprise a pressure sensor for indirectly sensing a change of an altitude by detecting a change of external air pressure, and the microcontroller is configured to predetermine that the movement change indicates the smoking action when the gravity sensor senses the certain range of the movement change of the electronic cigarette and meanwhile the pressure sensor also senses that the movement change has a certain change of an altitude difference from low to high.

4. The electronic cigarette with automatic preheating in anticipation of a smoking action according to claim 1, wherein the electronic components further comprise a microphone, an airflow sensor, or an air pressure sensor, for detecting a change of an air flow or air pressure during smoking, to allow the microcontroller to determine whether a user is smoking.

5. The electronic cigarette with automatic preheating in anticipation of a smoking action according to claim 4, wherein the preset parameters further comprise a preset standby time, and the microcontroller is configured to control the electronic cigarette to automatically enter a sleep state, if the microphone, the airflow sensor, or the air pressure sensor detects that the user has not taken a puff within the preset standby time after the electronic cigarette enters the standby smoking state.

6. The electronic cigarette with automatic preheating in anticipation of a smoking action according to claim 1, wherein the preheating element is an electric heater arranged in or out of the liquid storage chamber, the electric heater is configured to heat the electronic cigarette liquid in the liquid storage chamber when being energized; or, the preheating element is a heating element disposed in the vaporizing device for vaporizing electronic cigarette liquid, the heating element is configured to conduct heat to the electronic cigarette liquid in the liquid storage chamber when being energized.

7. The electronic cigarette with automatic preheating in anticipation of a smoking action according to claim 1, wherein the control circuit further comprises a preheating prompting unit, the preheating prompting unit comprises an LED indicator, and a vibrator or a buzzer, and the microcontroller is configured to control the LED indicator to emit light for warning when the microcontroller determines that preheating is required, and control the vibrator or the buzzer to provide vibration or sound for warning when the preheating is completed.

8. The electronic cigarette with automatic preheating in anticipation of a smoking action according to claim 1, wherein the preset heating period is set as a fixed value, or is set as a variable value having a linear inverse proportional function relation with the real-time temperature value, that is, the lower the real-time temperature value, the longer the preset heating period.

9. The electronic cigarette with automatic preheating in anticipation of a smoking action according to claim 1, wherein the preset parameters further comprise a preset preheating power, and the preset preheating power is set as a fixed value, or is set to have a linear inverse proportional function relation with the real-time temperature value, that is, the lower the real-time temperature value, the greater the preset preheating power.

10. The electronic cigarette with automatic preheating in anticipation of a smoking action according to claim 1, wherein the temperature detection unit comprises an independent temperature sensor, or, a heating coil for vaporizing the electronic cigarette liquid is used as a temperature sensor, and the heating coil has a characteristic of a thermosensitive resistor.

11. A control method of an electronic cigarette with automatic preheating in anticipation of a smoking action, applied to the electronic cigarette with automatic preheating in anticipation of a smoking action according to claim 1, comprising steps of:

(1) presetting related preset parameters through a microcontroller;

(2) sensing a movement change of the electronic cigarette by means of a gravity sensor, and meanwhile detecting a real-time temperature of an electronic cigarette liquid in a liquid storage chamber or an environment by means of a temperature detection unit;

(3) predetermining whether the movement change indicates a smoking action by means of the microcontroller, if yes, go to next step, if no, return to previous step;

(4) by means of the microcontroller, comparing a real-time temperature value with a preset minimum temperature value, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller.

12. A control method of an electronic cigarette with automatic preheating in anticipation of a smoking action, applied to the electronic cigarette with automatic preheating in anticipation of a smoking action according to claim 3, comprising steps of:

(1) presetting related preset parameters through a microcontroller;

(2) sensing a movement change of the electronic cigarette by means of a gravity sensor and meanwhile sensing a change of an altitude difference by means of a pressure sensor, and detecting a real-time temperature of an electronic cigarette liquid in a liquid storage chamber or an environment by means of a temperature detection unit;

(3) by means of the microcontroller, predetermining whether the movement change and the change of the altitude difference indicate the smoking action, if yes, go to next step, if no, return to previous step;

(4) by means of the microcontroller, comparing a real-time temperature value with a preset minimum temperature value, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller.

13. A control method of an electronic cigarette with automatic preheating in anticipation of a smoking action, applied to the electronic cigarette with automatic preheating in anticipation of a smoking action according to claim 5, comprising steps of:

(1) presetting related preset parameters through a microcontroller;

(2) sensing a movement change of the electronic cigarette by means of a gravity sensor, and meanwhile detecting a real-time temperature of an electronic cigarette liquid in a liquid storage chamber or an environment by means of a temperature detection unit;

(3) by means of the microcontroller, predetermining whether the movement change indicates the smoking action, if yes, go to next step, if no, return to previous step;

(4) by means of the microcontroller, comparing a real-time temperature value with a preset minimum temperature value, and determining whether preheating is required for the electronic cigarette, if yes, go to next step, if no, go to step (6);

(5) controlling a preheating element to be energized for preheating by means of the microcontroller;

(6) controlling the electronic cigarette to enter a standby smoking state by means of the microcontroller;

(7) detecting an air flow of smoking by means of a microphone;

(8) by means of the microcontroller, determining whether a user takes a puff within a preset standby time, if yes, go back to step (6), if no, go to next step;

(9) controlling the electronic cigarette to enter a sleep state by means of the microcontroller.

* * * * *